US008061897B2

(12) United States Patent
Ichikawa et al.

(10) Patent No.: US 8,061,897 B2
(45) Date of Patent: Nov. 22, 2011

(54) PACKAGE

(75) Inventors: Toru Ichikawa, Tokyo (JP); Kenji Nagata, Tokyo (JP); Kong Mun Chew, Singapore (SG)

(73) Assignee: Menicon Singapore Pte Ltd., Singapore (SG)

( * ) Notice: Subject to any disclaimer, the term of this patent is extended or adjusted under 35 U.S.C. 154(b) by 909 days.

(21) Appl. No.: 11/345,219

(22) Filed: Feb. 2, 2006

(65) Prior Publication Data

US 2006/0182909 A1 Aug. 17, 2006

(30) Foreign Application Priority Data

Feb. 14, 2005 (JP) ..... 2005-036281

(51) Int. Cl.
*B65D 33/00* (2006.01)
*B65D 1/09* (2006.01)
*A45C 11/04* (2006.01)

(52) U.S. Cl. ..... 383/35; 383/210; 206/528; 206/5.1

(58) Field of Classification Search ..... 383/35, 383/65, 210, 211; 206/528, 530, 532, 440, 206/69, 5.1
See application file for complete search history.

(56) References Cited

U.S. PATENT DOCUMENTS

| | | | | | |
|---|---|---|---|---|---|
| 2,954,116 | A | * | 9/1960 | Maso et al. | 206/484.2 |
| 2,973,859 | A | * | 3/1961 | Schladermundt et al. | 206/441 |
| 3,613,879 | A | * | 10/1971 | Kemble | 206/210 |
| 3,726,057 | A | * | 4/1973 | Kemble | 53/425 |
| 4,444,310 | A | * | 4/1984 | Odell | 206/366 |
| 4,849,606 | A | * | 7/1989 | Martens et al. | 392/390 |
| 4,998,621 | A | * | 3/1991 | Meehan | 206/466 |
| 5,009,828 | A | * | 4/1991 | McCree | 264/177.1 |
| 5,092,684 | A | * | 3/1992 | Weeks | 383/61.2 |
| 5,382,094 | A | * | 1/1995 | Ausnit | 383/65 |
| D356,889 | S | * | 4/1995 | Abrams et al. | D3/264 |
| D357,115 | S | * | 4/1995 | Abrams et al. | D3/264 |
| 5,527,112 | A | * | 6/1996 | Dais et al. | 383/211 |
| 5,944,189 | A | * | 8/1999 | Vollenweider et al. | 206/484 |
| 6,029,808 | A | * | 2/2000 | Peck et al. | 206/210 |
| 6,210,038 | B1 | | 4/2001 | Tomic | |
| D462,900 | S | * | 9/2002 | Yamada et al. | D9/416 |
| 6,929,128 | B2 | * | 8/2005 | Caldwell et al. | 206/466 |
| 7,422,105 | B2 | * | 9/2008 | Loyd et al. | 206/438 |
| 7,477,366 | B2 | * | 1/2009 | Clements et al. | 356/124 |
| 2006/0054514 | A1 | * | 3/2006 | Tokarski et al. | 206/5.1 |
| 2006/0213783 | A1 | * | 9/2006 | Tokarski et al. | 206/5.1 |
| 2008/0017525 | A1 | * | 1/2008 | Newman | 206/5.1 |
| 2008/0063325 | A1 | * | 3/2008 | Miller et al. | 383/211 |

FOREIGN PATENT DOCUMENTS

DE 74 35 910 U 2/1975

(Continued)

*Primary Examiner* — Jes F Pascua
(74) *Attorney, Agent, or Firm* — Holland & Hart LLP

(57) ABSTRACT

A package has a package body formed by mating film materials and sealing peripheral edge portions of the mated film materials so as to form a content accommodation compartment inside the sealed peripheral edge portions, the sealed peripheral edge portions being subjected to an easily peel-off treatment so that the sealed peripheral edge portions are separated and peeled off from each other when the package is opened. A seal opening starting portion is formed outside of one of the sealed peripheral edge portions so that the film materials are separated from each other at the seal opening starting portion, and at least one projection is provided on at least one of inner and outer side surfaces of the film materials forming the seal opening starting portion.

18 Claims, 10 Drawing Sheets

FOREIGN PATENT DOCUMENTS

| | | | |
|---|---|---|---|
| EP | 0 648 687 | A | 4/1995 |
| GB | 1337809 | A | 11/1973 |
| JP | 56103487 | U | 8/1981 |
| JP | 6-48468 | | 2/1994 |
| JP | 6092388 | | 4/1994 |
| JP | 20000007020 | | 1/2000 |
| JP | 2000502310 | | 2/2000 |
| JP | 2003070851 | | 3/2003 |

* cited by examiner

PACKAGE

FIELD OF THE INVENTION

The present invention relates to a package or packaging bag which is opened by separating mated and joined film materials from each other.

RELATED ART

Some of packages or packaging bags (called "package" hereinlater for the sake of convenience) has a structure in which two materials are mated and sealed at their peripheral edge portions so as to provide a package form having an inner hollow portion into which an inner content is to be filled up, the inner hollow portion being formed as an inner content accommodation compartment. In such package, a known technology provides a structure in which the sealed portion is subjected to an easily separable or peel-off treatment to thereby easily separate the sealed two materials from each other.

One example of such package is disclosed in Japanese Patent Laid-open (KOKAI) Publication No. HEI 6-48468. The package disclosed in this publication is composed of a container having an opening and a lid to tightly seal the opening. A flanged portion is formed to the peripheral edge portion of the opening so as to project outward, and the lid is sealed, at its peripheral edge portion, to the flanged portion. Furthermore, an easily separable treatment is effected to this sealed portion so as to separate or peel off the sealed flanged portion and lid portion with a predetermined peel-off force, thus the lid being separated from the container.

However, when the package formed by mating and sealing the two film materials is made small in size in accordance with a size or amount of a content which fills an accommodation compartment of the package, it is difficult to peel off the sealed portion, and hence, to open the package. That is, when the package becomes small, the opening starting portion (i.e., seal peel-off starting portion) will also become small, so that it is difficult to open such package for a person having a large size hand or with wet fingers.

SUMMARY OF THE INVENTION

The present invention was made in consideration of the above matters and an object of the present invention is to provide a package formed by mating and sealing film materials and having a seal opening starting structure for easily opening the package.

This and other objects can be achieved according to the present invention by providing a package comprising: a package body formed by mating film materials and sealing peripheral edge portions of the mated film materials so as to form a content accommodation compartment inside the sealed peripheral edge portions, the sealed peripheral edge portions being subjected to an easily peel-off treatment so that the sealed peripheral edge portions are separated and peeled off from each other when the package is opened; a seal opening starting portion formed outside of one of the sealed peripheral edge portions so that the film materials are separated from each other at the seal opening starting portion; and at least one projection provided on at least one of inner and outer side surfaces of the film materials forming the seal opening starting portion.

In preferred embodiments, the projections may be provided on the surfaces of both the mated film materials. The projections may be shifted in positions from each other.

It is desirable that the seal opening starting portion has a thickness substantially equal to a thickness of the content accommodation compartment containing the content.

It may be also desired that independent two sheets of film materials are mated and sealed at the peripheral edge portions of the mated film materials so as to provide the inner content accommodation compartment.

Furthermore, it may be desired that one sheet of film material is folded at a central portion in a longitudinal direction thereof and the folded film materials are mated and sealed to each other at peripheral edge portions other than the folded one edge portion, and the seal opening starting portion is formed on the edge side portion opposing to the folded one edge side portion.

The projection may be provided on the surface of the film material through a fusing process by means of hot air, through a heat-seal treatment, or by means of bonding.

The projection may be composed of a projection member, having a rectangular, circular or like cross section, disposed at the seal opening starting portion. The projection member is composed of a linear projection member extending substantially entirely transversely at a portion at which the seal opening starting portion is formed. The projection may be composed of a curved projection member extending transversely at a portion at which the seal opening starting portion is formed.

According to the present invention including the preferred embodiments, when the package is opened by separating and peeling off the sealed portion formed by sealing the mated film materials, the seal opening starting portion can be easily nipped with fingers. That is, the projection, which is engaged with the fingers for opening the package, is provided to the seal opening starting portion, thus easily opening the sealed portion of the package. In the case where the projection is formed to the inner side surface of the film material, a gap is created between the mated film material, thus also easily nipping the projection and opening the sealed package. Accordingly, such package can be also easily opened by a person having a large hand or fingers and a person having wet hand or fingers.

In addition, since the seal opening operation can be easily performed, the peel-off strength at the sealed portion can be made large to thereby improve the sealing performance greatly. For example, for the conventional package provided with no projection, it was difficult to form the package which was opened with an seal opening force of more than 1500 g/15 mm. On the contrary, for the package of the present invention having the projection, the package which is opened with the seal opening force of 500 to 2000 g/15 mm can be provided.

Furthermore, according to the present invention, the length of the seal opening starting portion can be made short so as to easily open the sealed package. That is, the length of the seal opening starting portion extending from the upper sealed edge portion of the package can be made short, so that the package can be made compact and the film material can be saved in amount, thus being advantageous.

Still furthermore, in the structure in which the height of the projection, i.e., the thickness of the seal opening starting portion is made equal to the thickness of the content accommodation compartment, when such packages are stacked, the packages can be stacked in good balance in height, thus being particularly suitable for the packages being packaged in a box.

The nature and further characteristic features of the present invention will be made more clear from the following descriptions with reference to the accompanying drawings.

DESCRIPTION OF THE PREFERRED EMBODIMENT

Figure 1:
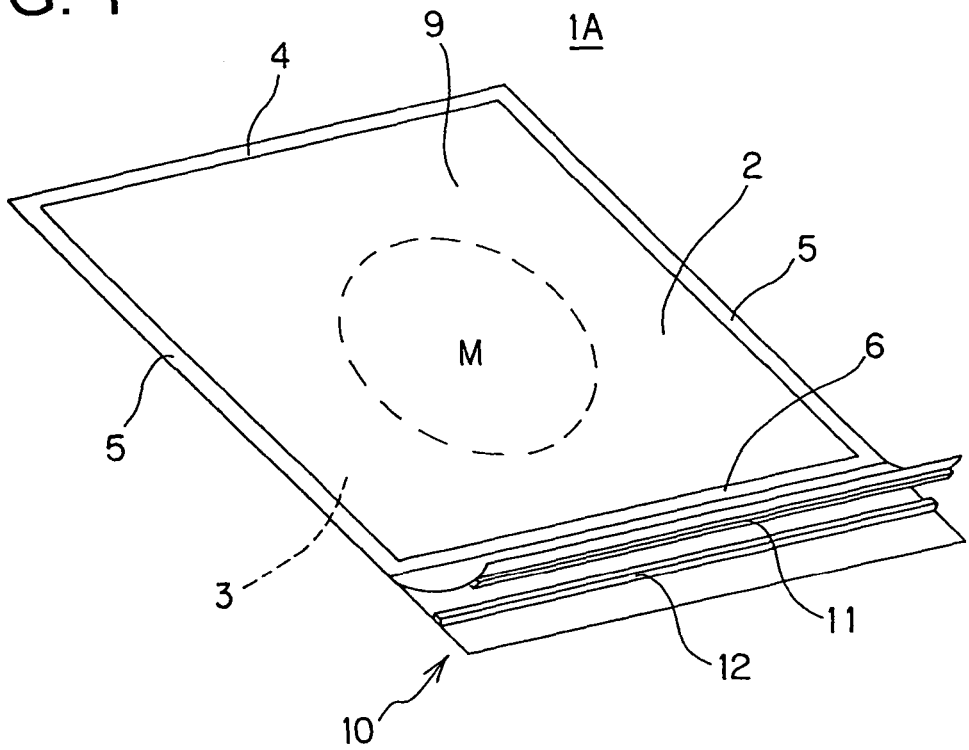
FIG. 1 is a perspective view of a package according to one embodiment of the present invention.

A preferred embodiment of the present invention will be described hereunder with reference to the accompanying drawings. Further, it is to be noted that terms "upper", "lower" and the like terms are used herein with reference to the illustration in the drawings or "upper" corresponds to top side of a package on which an opening is formed and "lower" corresponds to a bottom side of the package.

Figure 2:
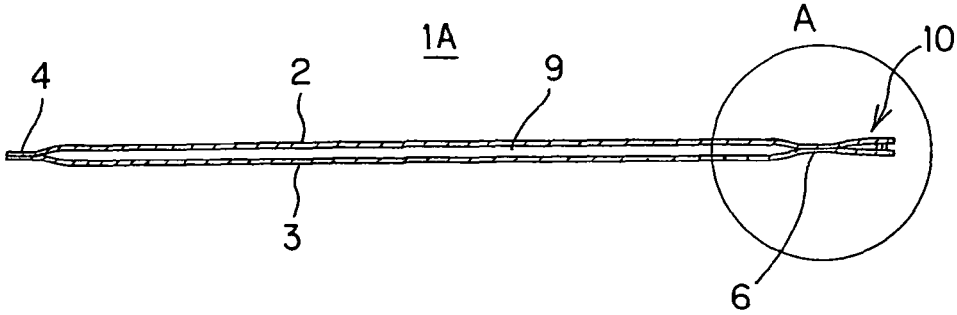
FIG. 2 is a sectional view taken along a longitudinal direction of the package shown in FIG. 1.
Figure 3:
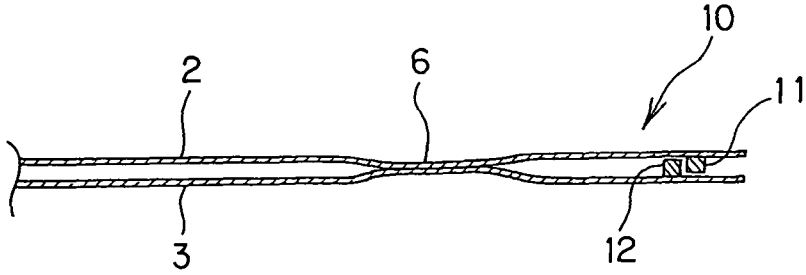
FIG. 3 is a sectional view in an enlarged scale of a portion "A" shown in FIG. 2.

FIGS. 1 to 3 represent a package 1A according to one embodiment of the present invention.

The package 1A is formed by mating, in an overlapping manner, two rectangular sheets of film materials 2 and 3, and the package 1A is provided with sealed portions 4, 5 and 6 which have a constant width at bottom, both sides and top portions of the package 1A. Further, the top side seal portion 6 is formed slightly inside the top end edge portion thereof, and an inner hollow portion surrounded by such seal (or sealed) portions 4, 5 and 6 is formed as an accommodation compartment 9 of an inner content M.

A seal opening starting portion (a portion from which a sealed portion opening operation starts) 10 is formed the upper edge portion forming one side portion of the package 1A. This seal opening starting portion 10 is composed of portions of the film materials 2 and 3 forming the package 1A (i.e., a part of the package 1A) and widened slightly outward from the top seal portion at a slightly inside from the top end edge portion mentioned above.

The package 1A may be utilized for accommodating a small article such as tablet, contact lens or contraceptive, a liquefied fluid such as shampoo or jelly, or a powder such as chemical or condiment.

The package 1A is opened by separating two film materials 2 and 3 from each other from the seal opening starting portion 10 and peeling off the sealed portions 4, 5 and 6, and these sealed portions 4, 5 and 6 are subjected to easily seal-peel-off treatment. As this easily peel-off treatment, there may be adopted various types such as cohesive-peel-off type, lamination-peel-off (delamination) type or boundary-peel-off type, but not limited thereto, as far as the fine sealed state can be ensured of the package 1A in the sealed state, and the sealed film materials 2 and 3 can be easily peeled off when opened.

Figure 4:
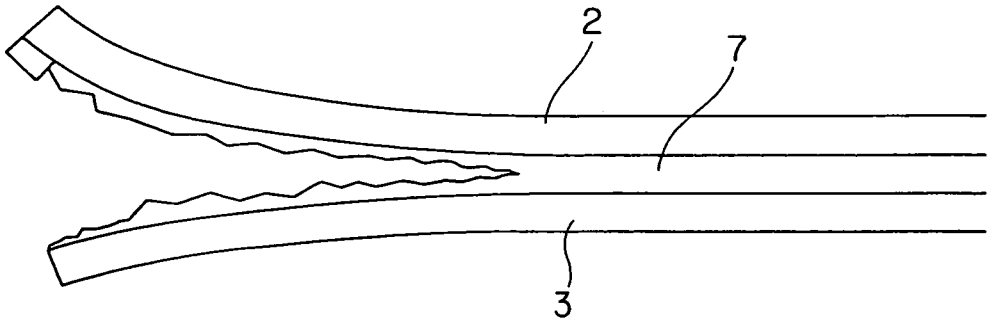
FIG. 4 is a schematic view explaining a cohesive-peel-off type easily peel-off treatment.
Figure 5:
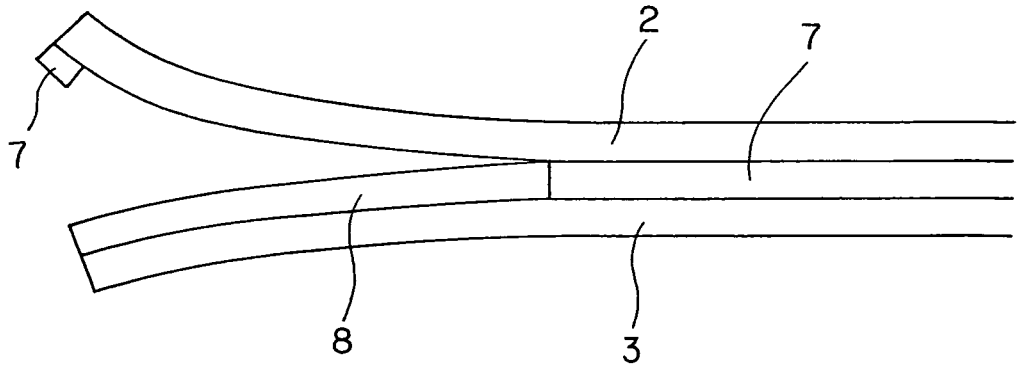
FIG. 5 is a schematic view explaining a delamination (lamination-peel-off) type easily peel-off treatment.
Figure 6:
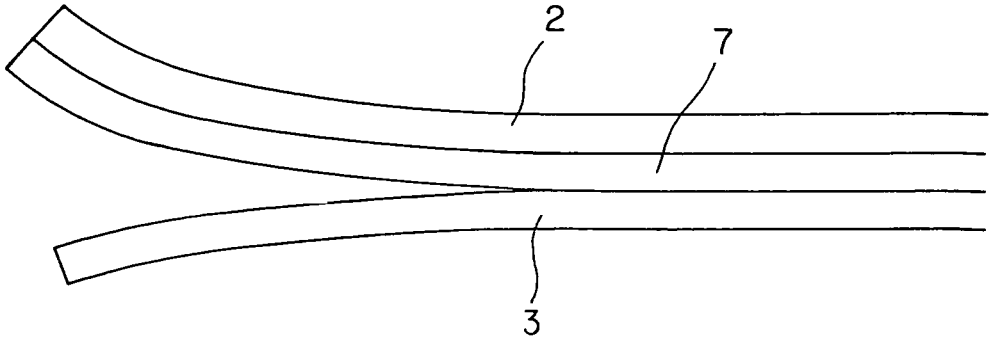
FIG. 6 is a schematic view explaining a boundary-peel-off type easily peel-off treatment.

The cohesive-peel-off type is a type shown in FIG. 4, in which a seal layer 7 is itself broken and separated, and hence, the seal material remains to both the film materials 2 and 3. The lamination-peel-off type is a type shown in FIG. 5, in which a lamination of the film materials 2 and 3 is formed through co-extrusion and a sealing strength between a support layer 8 and the seal layer 7 is made weak so as to separate the support layer and the seal layer 7 from each other at the seal opening starting time. The boundary-peel-off type is a type shown in FIG. 6, in which the seal layer 7 is entirely peeled off together with one film material 2 (3) from the other film material 3 (2), and as such boundary-peel-off type, an easily adhesive resin such as ethylene-vinyl acetate copolymer will be utilized.

As a matter of essential, the following characteristic features will be required for the package 1A. That is, it is required:

1. to be tasteless, odourless and non-poisonous;
2. to have an applicability to machines, and especially, to have a wide applicable range of heat sealing performance (temperature, pressure, time);
3. to have a superior trimming and cutting performance;
4. to have a good seal through contamination (i.e., good seal performance to contamination or impurity) neaeaa-SOUZATSUBUTSU sealing performance when applied to the package 1A for a fluid including jelly-like materials;
5. to have less dimensional change, and particularly, to have a contraction follow-up property when requiring tensioning;
6. to have a transparency when it is required to confirm the inner content M from the outside of the package 1A;
7. to be designable so as to be adopted individually according to usage with a peel strength in a range of 500 to 2000 g/15 mm;
8. to have a stable peel strength against heat sterilization, change of use condition, and so on and have no change in time elapse;
9. to have a superior strength against the inner content M, and that is, not to provide an orange-peel state due to fat and oil contained in the content M at the time of heat sterilization;
10. to have no knocking and peeling noise at the peeling time and to be smoothly peeled off; and 11. Not to cause any feathering such that stringiness or thin film remains on the peeled surface and to provide a fine peeled surface.

Other than the above matters, it will be necessary to avoid the causing of curling, pitch defective or like due to the lamination of a printed film and to consider seal form, suitability for a sealer, and the like.

With reference to FIGS. 1 to 3, the seal opening starting portion 10 will be further described hereunder.

The seal opening starting portion 10 includes the portions of the film materials 2 and 3 not bonded and separated from each other, and projections or projecting members 11 and 12 are provided on the inner surfaces of the respectively opposing film materials 2 and 3. These projections 11 and 12 provides a gap between the film materials 2 and 3 so as to nip or pinch the film materials with fingers and then separate them from each other. In this embodiment, the projections 11 and 12 are formed as linear projection members each extending in the transverse; i.e., width, direction of the package 1A and having a rectangular shape in section.

These projections 11 and 12 are attached to the inner surfaces of the film materials 2 and 3 with a slight sift so as not to be overlapped with each other in locations. In the illustration of the present embodiment of the package 1A, as shown in FIG. 3, the projection 11 formed to the upper side film material 2 is positioned on the upper edge side (right side as viewed) of the package 1 with respect to the other projection 12 formed to the lower side film material 3. According to such shifting of the projections 11 and 12 in their locations, the gap between the film materials 2 and 3 can be surely formed with the extremely thin thickness of the seal opening starting portion 10 being maintained.

The projections 11 and 12 are attached on the film materials by fusing the projections 11 and 12 on the film materials 2 and 3 by means of hot air or heat-seal process. Furthermore, the projections 11 and 12 may be bonded with a bonding agent, or formed by injecting a resin material on the film materials 2 and 3.

Further, it is to be noted that the above-mentioned projection forming method or process may be applicable for the provision of the projections in other embodiments mentioned hereinafter.

As the film materials 2 and 3 for forming the package 1A, a lamination film of PET (polyethylene terephthalate) 12 μm/Al (aluminium) 20 μm/PET 12 μm/CPP (cast polypropylene) 60 μm is utilized. The CPP 60 μm is a film bonded to each inner surface of the film materials 2 and 3 for easy peel-off treatment.

The package 1A formed as mentioned above will be opened in the manner shown in FIGS. 7A to 7C.

Figure 7A:
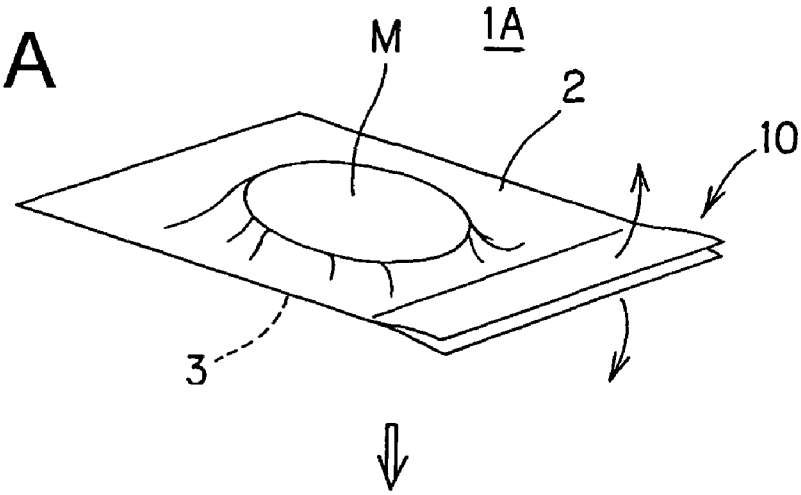
FIGS. 7A to 7C are views for explaining sequences for opening the package.

First, with reference to FIG. 7A, the portions of the film materials 2 and 3 constituting the seal opening starting portion 10 are nipped with fingers, respectively, and then separated from each other. In this time, since the projection members 11 and 12 are formed to the opposed inner surfaces of the respective film materials 2 and 3, the film materials 2 and 3 can be easily nipped with fingers, respectively. When the film materials 2 and 3 are nipped, the projection members 11 and 12 engage with the fingers and then serves as a grip member, thus the film materials 2 and 3 being further easily separated from each other.

Figure 7B:
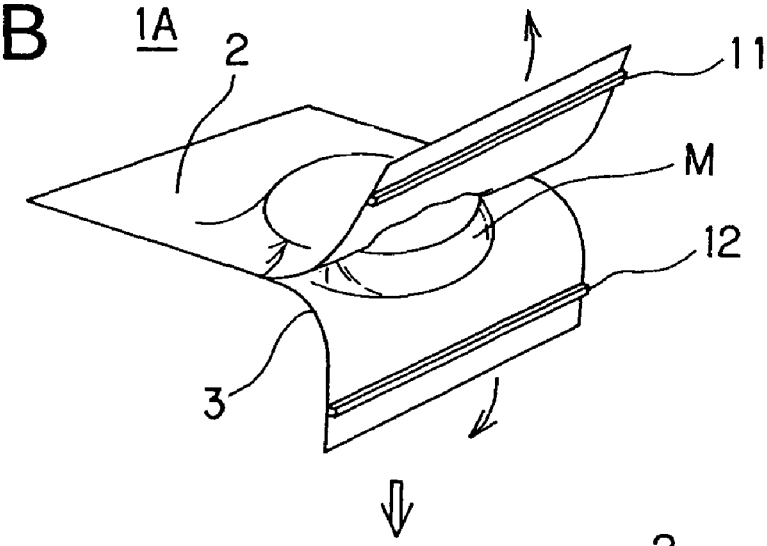
Figure 7C:
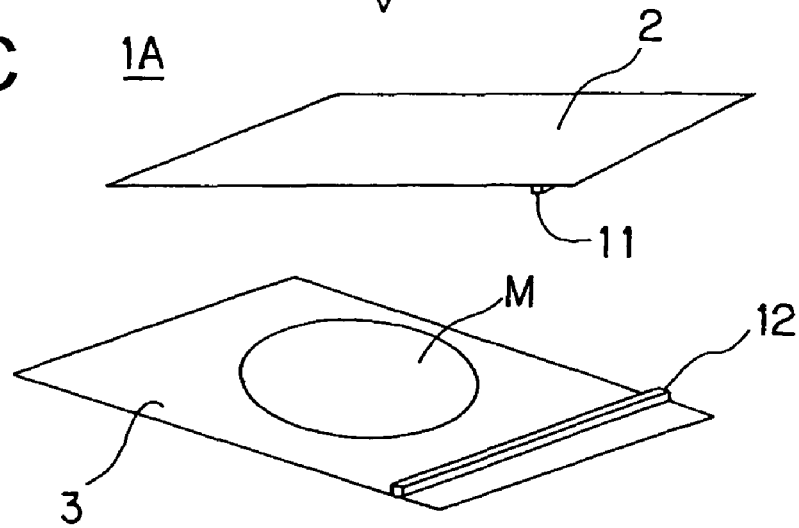

When the separation of the film materials 2 and 3 proceeds as shown in FIG. 7B, the side and top sealed portions 5 and 6 are peeled off and the inner content M is exposed. When the film materials 2 and 3 are further separated, all the sealed portions 4, 5 and 6 are peeled off and separated as shown in FIG. 7C, thus completing the seal opening operation.

The peel-off strength at the sealed portions will be explained hereunder.

For a package provided with no projection or projection members 11 and 12, it will be required for the film materials 2 and 3 to be bonded (sealed) so as to have the peel-off strength of about 500 to 1500 g/15 mm in consideration of the seal opening operation. On the other hand, for the package 1A according to the one preferred embodiment of the present invention, the bag opening operation can be made easy by the provision of the projections 11 and 12, so that the peel-off strength can be increased up to about 2000 g/15 mm, thus providing the package having an increased sealing performance.

In addition, the easy opening of the package allows a length of the film materials 2 and 3 extending outward from the top seal portion 6 constituting a root of the seal opening starting portion 10 to be made short. For this reason, the total longitudinal length of the package 1A can be shortened with the inner volume of the accommodation compartment 9 being maintained, which also serves to save the raw material for the package 1A.

Figure 8:
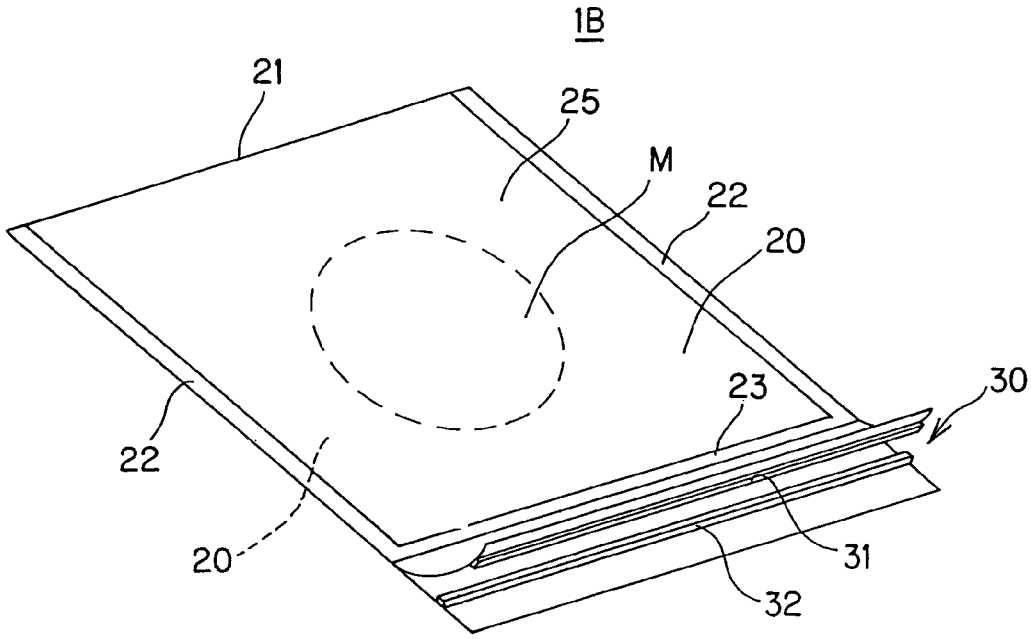
FIG. 8 is a perspective view of a package formed by folding a film material into two sections.
Figure 9:
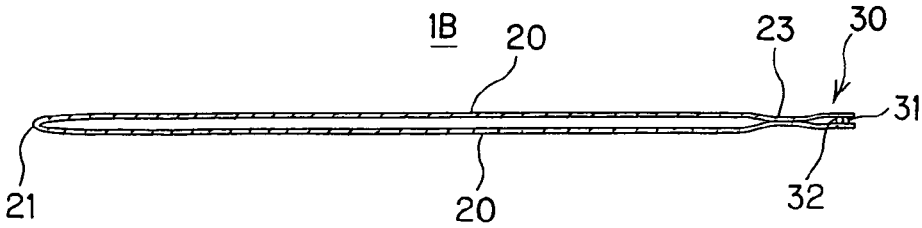
FIG. 9 is a sectional view taken along a longitudinal direction of the package shown in FIG. 8.

In the above embodiment, although two film materials 2 and 3 are overlapped and bonded together, one sheet of film material may be utilized by folding the same into two parts as shown in FIG. 8 or 9 as package 1B.

In this embodiment shown in FIG. 8 or 9, the package 1B is formed by folding, into two portions, one sheet of film material 20 at its central portion. The folded line portion 21 is formed as a bottom portion of the package 1B and an opposing portion is formed as upper portion thereof. The side portions and the upper portion slightly inward from the upper edge of the folded film material 20 are sealed together with a constant width therealong as side and top (upper) seal portions 22 and 23, respectively. The inside portion surrounded by these folded bottom portion 21, side seal portions 22 and top seal portion 23 serves as inner content accommodation compartment 25 for accommodating the inner content M.

To the upper edge portion of the package 1B, there is formed a seal opening starting portion 30, which also constitute a portion of the film material 20 extending slightly outward from the top seal portion 23 of the package 1B as mentioned above.

For the seal portions 22 and 23 this package 1B, the easy seal opening treatment are made as mentioned before for the package 1A, and projections or projection members 31 and 32 are provided to the opposing inner surface of the film material 20 at the seal opening starting portion 30.

In the foregoing two embodiment, although the projection has a rectangular cross section, the projection may be formed so as to have another shaped cross section such as circular or like section.

Figure 10:
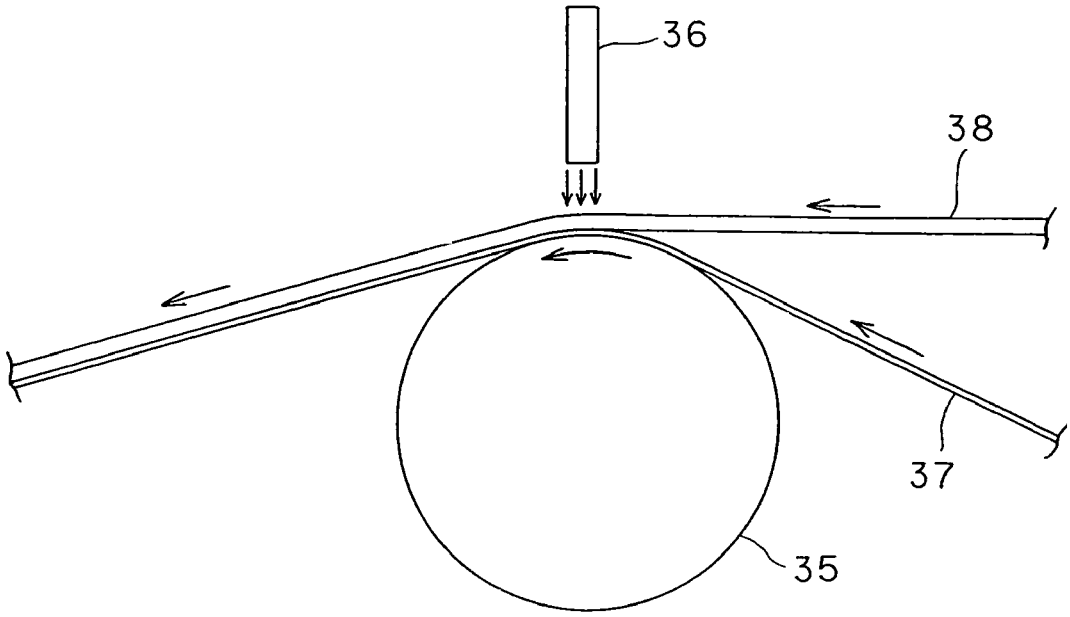
FIG. 10 is a schematic view showing a state of attaching a linear member as projection member.

In such case, the projection may be formed in another manner such as shown in FIG. 10.

FIG. 10 schematically shows a process in which a linear member 38 having a circular cross section is attached to a film material 37 as one example.

In this process, a belt shaped film material 37 is guided in its longitudinal direction by a guide roller 35, and the linear member 38 as projection is guided by the guide roller 35 in the axial direction of the linear member 38. The linear member 38 is positioned on one or each side in the width direction of the film material 37 at the circumferential surface portion of the guide roller 35.

A heater having a nozzle 36 is disposed above the guide roller 35 so that the nozzle 36 is directed to the outer peripheral surface of the guide roller 35. A hot air is ejected through the nozzle 36 of this heater so as to heat the linear member 38 and the film material 37. Thus, the linear member 38 is heated by the ejected hot air during the guidance by the guide roller 35, and the lower surface portion of the linear member contacting the film material 37 is fused to the film material 37 as illustrated in FIG. 11.

When the linear member having the circular cross section is used, in comparison with that having the rectangular cross section, the linear member 38 has a high surface (bearing) pressure at its contacting portion to the film material 37, and in addition, since the circular linear member 38 has a small portion to be contacted to the film material 37, the contacted portion can be easily fused in comparison with the rectangular linear member in the former embodiments, thus being effective and advantageous in the utilization of the linear member having a circular cross section.

In this method, it may be possible to use the film material cut in the size suitable for making one package and the linear member cut in the size suitable therefore, which is fused to the film material through the heating process.

Figure 11:
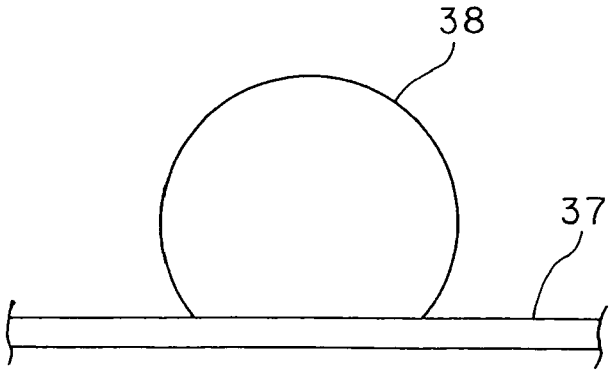
FIG. 11 shows a state that the liner member is attached to the film material.
Figure 15:
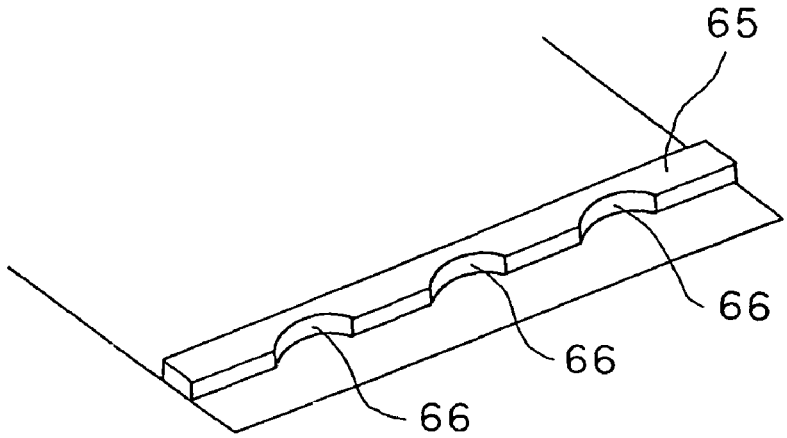
FIG. 15 is a schematic perspective view showing another example of a linear member as projection member formed with notches with which fingers of a person are engaged.
Figure 16:
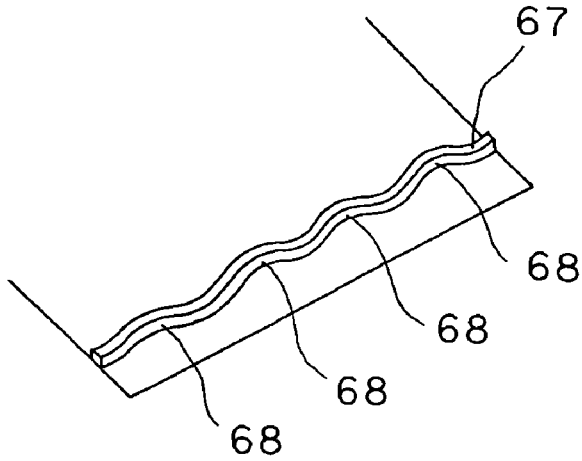
FIG. 16 is a schematic perspective view showing a further example of a projection member in a wave-shape form.

In the example shown in FIGS. 10 and 11, although the sectional shape of the linear member is limited to the circular shape, the present invention is not limited to such circular shape and a semi-circular shape may be adopted as well as rectangular shape. Moreover, a linear or like member having notches or having a wave-shape which are formed at predetermined interval in the axial direction may be adopted such as shown in FIGS. 15 and 16 and described later. Furthermore, the fusing method is not limited to the use of the hot air and a heat-seal method may be also utilized for fusing the linear member to the film material. In a further alternation, the linear member may be bonded by a bonding agent.

In the described embodiments, although there is described the packages have a rectangular outer configuration, the present invention is not limited to such shape and other package having outer configurations other than the rectangular shape may be adopted.

Figure 12:
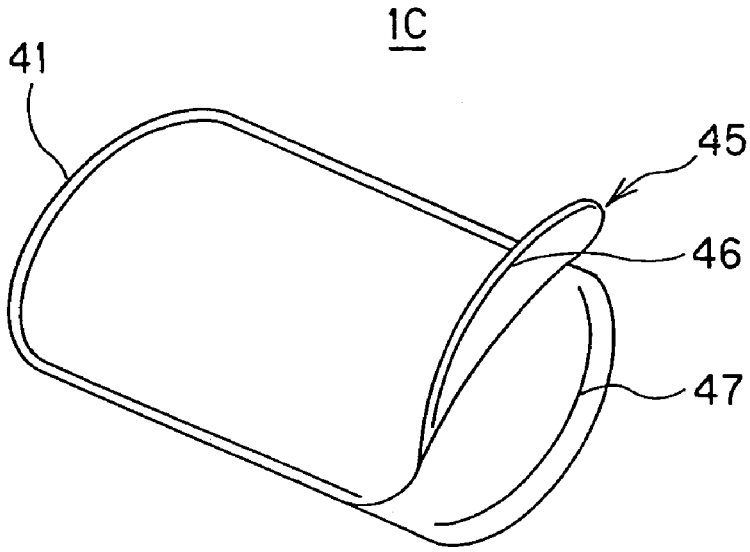
FIG. 12 is a perspective view showing a package having arcuate (circular-arc or round) portions at its top and bottom portions.

For example, as shown in FIG. 12, a package 1C has a bottom portion 41 and an upper (top) edge portion forming a seal opening starting portion 45, both having a round or circular shape. In this embodiment, projections 46 and 47 attached to the inner surfaces of the opposed film materials may be formed so as to provide a curved shape along the upper edge portion of the package 1C as well as linear shape as mentioned before.

Figure 13:
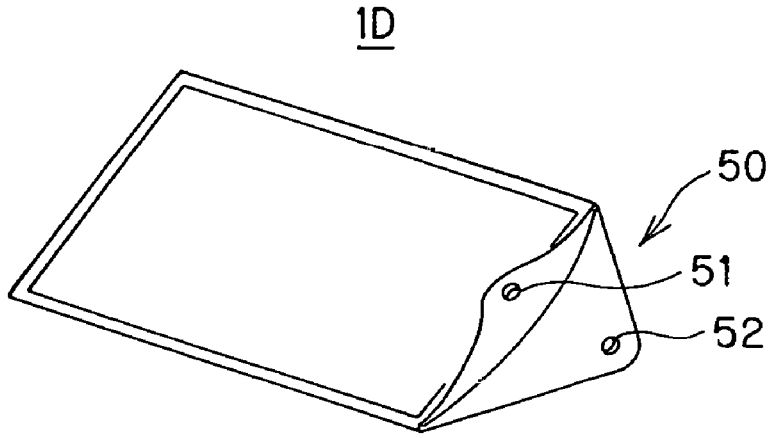
FIG. 13 is a perspective view showing a package having a tapered front end portion from which the package is opened.

Furthermore, FIG. 13 shows a further embodiment of a package 1D having an upper edge portion tapered outward and formed as a seal opening starting portion 50. In this embodiment, point projections or partial projections 51 and 52 may be adopted, except for the linear projections, so as to be suitable for the shape of the seal opening starting portion for the package 1D as shown in FIG. 13 having the tapered seal opening starting portion 50.

Figure 14:
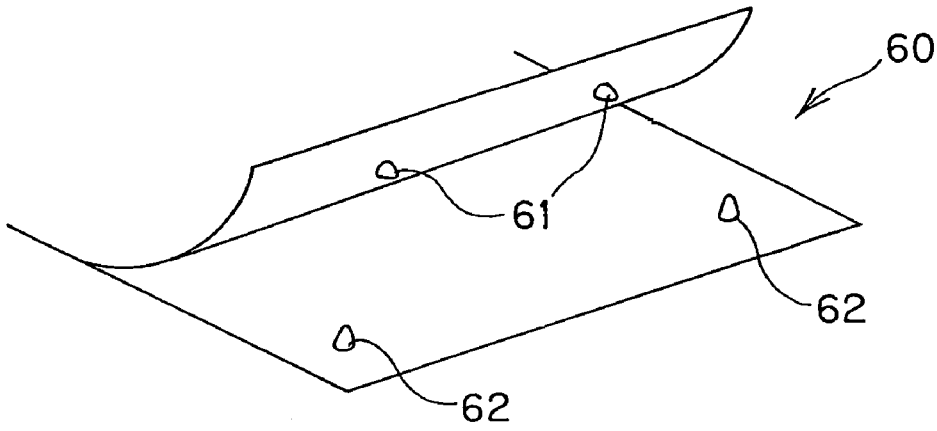
FIG. 14 is a schematic perspective view showing a seal opening starting portion formed with projections different in form from that of the first embodiment of FIG. 1.

FIG. 14 shows a further embodiment of a package according to the present invention, the package having a rectangular shape having a rectangular seal opening starting portion 60. In this embodiment, point or short linear projections 61 and 62 are formed respectively on the inner surfaces of the mated film materials, and the projections 61 and 62 are formed side end portions in the width direction of the package, thus forming the seal opening starting portion 60, with slightly shifted arrangement from each other so as to form a gap between the mated film materials to thereby reduce the thickness of the seal opening starting portion 60.

FIGS. 15 and 16 show further embodiments of a package according to the present invention, in which projections 65 and 67 are formed with circular recesses 66 and 68 with which fingers are engaged for opening the seal of the package. FIG. 15 shows the example of the projections each having circular notches 66, and FIG. 16 shows the example of the projections each having a circular wave-shape 68. According to the formation of such projections 65 and 67 having circular recesses 66 and 68, the fingers of a person can be linearly contacted to the projections to thereby easily nip the projections.

Figure 17:
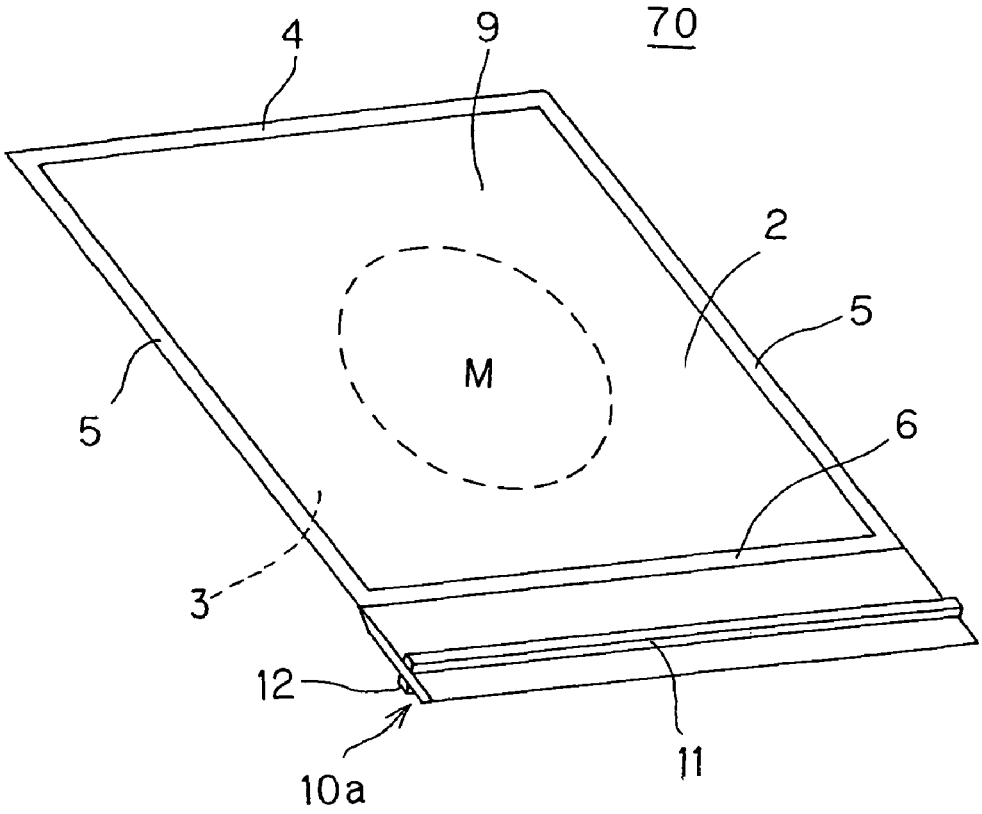
FIG. 17 is a perspective view of a package according to another embodiment of the present invention in which projection members are formed to outer surfaces of a seal opening starting portion of the package.

Still furthermore, FIG. 17 shows a further embodiment of a package according to the present invention, in which projections 11 and 12 are attached to the outer surface sides of portions of the film materials 2 and 3 forming a seal opening starting portion 10*a*. The package 70 of this embodiment has substantially the same structure as the package 1A and the same portions are added with the same reference numerals and the descriptions thereof are omitted herein. The package 70 of this embodiment differs from the package 1A in the arrangement of the projections 11 and 12 which are formed to the outer surfaces of the film materials 2 and 3.

The packages of all the embodiments of the present invention described above can provide further characteristic features and advantages in addition to those mentioned hereinbefore.

Figure 18:
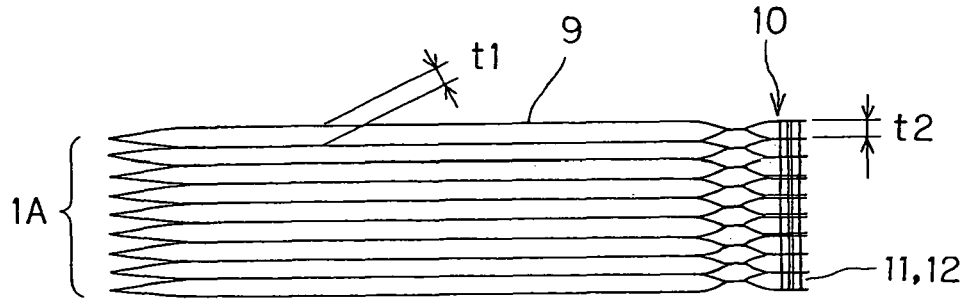
FIG. 18 is an illustration of a plurality of stacked packages of the embodiment shown in FIG. 1.

FIG. 18 is a schematic view showing a plurality of packages 1A in a stacked state. In each of the package 1A, the height of the projection 11 (12) is set such that a thickness t2 of the seal opening starting portion 10 is equal to a thickness t1 of the accommodation compartment 9 in which the content is accommodated. According to such setting of the height of the projection 11 (12), the total thickness of the seal opening starting portions of the stacked packages 1A is substantially equal to that of the stacked content accommodation compartments, thus being advantageous particularly at a time of packaging the packages 1A in a box.

Figure 19:
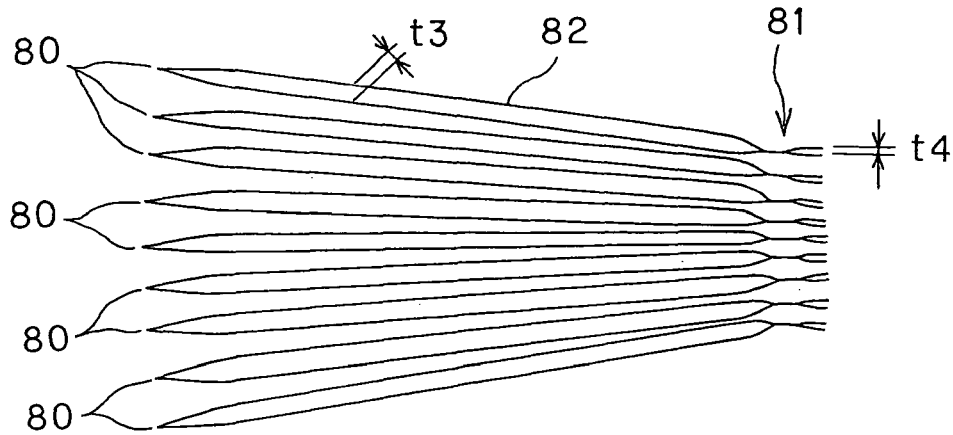
FIG. 19 is an illustration of a plurality of stacked packages provided with no projection members.

On the other hand, FIG. 19 shows a stacked state of packages 80 each provided with no projection, in which a seal opening starting portion 81 has a small thickness t4 and a content accommodation compartment 82 has a thickness t3 larger than the thickness t4. In this example, a plurality of packages 80 are stacked, bottom portions of the stacked packages 80 will be opened in shape of segment, thus being disadvantageous and troublesome particularly at the time of packaging the packages 80 in a box.

As mentioned above, the formation of the projections contributes to the adjustment of the height at the time of stacking a plurality of packages.

It is further to be noted that the present invention is not limited to the described embodiments, and many other changes and modifications may be made without departing from the scopes of the appended claims.

For example, in an alternation, a projection may be formed or attached onto the surface of only one of the film materials without forming on both the surfaces thereof.

What is claimed is:

1. A package comprising:

a package body formed by mating foldable laminate film materials and sealing peripheral edge portions of the mated film materials so as to form a content accommodation compartment inside the sealed peripheral edge portions, said sealed peripheral edge portions being subjected to an easily peel-off treatment so that the sealed peripheral edge portions are separated and peeled off from each other when the package is opened;

a seal opening starting portion formed outside of one of the sealed peripheral edge portions so that the film materials are separated from each other at the seal opening starting portion; and at least one projection provided on an inner surface of the film materials forming the seal opening starting portion;

wherein said at least one projection defines a thickness at said seal opening starting portion that is substantially equal to a thickness of the content accommodation compartment containing the content, wherein said sealed peripheral edge has a thickness that is less than said thickness of the content accommodation compartment;

wherein said projections are provided on the surfaces of both the film materials; and wherein said projections provided on the surfaces of both the film materials are shifted in positions from each other.

2. The package according to claim 1, wherein two independent sheets of film materials are mated and sealed at the peripheral edge portions of the mated film materials so as to provide the inner content accommodation compartment.

3. The package according to claim 1, wherein one sheet of film material is folded at a central portion in a longitudinal direction thereof and the folded film materials are mated and sealed to each other at peripheral edge portions other than the folded one edge portion, and the seal opening starting portion is formed on the edge side portion opposing to the folded one edge side portion.

4. The package according to claim 1, wherein said projections are provided on the surface of the film material through a fusing process by means of hot air.

5. The package according to claim 1, wherein said projections are provided on the surface of the film material through a heat-seal treatment.

6. The package according to claim 1, wherein said projections are provided on the surface of the film material by means of bonding.

7. The package according to claim 1, wherein each of said projections are composed of a projection member, having a rectangular cross section, disposed at the seal opening starting portion.

8. The package according to claim 7, wherein said projection member is composed of a linear projection member extending substantially entirely transversely at a portion at which the seal opening starting portion is formed.

9. The package according to claim 1, wherein said sealed peripheral edge portions of the mated film material have a peel-off strength that is less than a peel-off strength at said seal opening starting portion, wherein a peel-off strength of said sealed peripheral edge at said seal opening starting position comprises approximately 2000 g/15 mm.

10. A package comprising:

a package body formed by mating foldable laminate film materials and sealing peripheral edge portions of the mated film materials so as to form a content accommodation compartment inside the sealed peripheral edge portions, said sealed peripheral edge portions being subjected to an easily peel-off treatment so that the sealed peripheral edge portions are separated and peeled off from each other when the package is opened;

a seal opening starting portion formed outside of one of the sealed peripheral edge portions so that the film materials are separated from each other at the seal opening starting portion; and at least one projection provided on an inner surface of the film materials forming the seal opening starting portion;

wherein said at least one projection defines a thickness at said seal opening starting portion that is substantially equal to a thickness of the content accommodation compartment containing the content, wherein said sealed peripheral edge has a thickness that is less than said thickness of the content accommodation compartment;

wherein said projection is composed of a projection member, having a circular cross section, disposed at the seal opening starting portion.

11. The package according to claim 10, wherein said projection member is composed of a linear projection member extending substantially entirely transversely at a portion at which the seal opening starting portion is formed.

12. A package comprising:

a package body formed by mating foldable laminate film materials and sealing peripheral edge portions of the mated film materials so as to form a content accommodation compartment inside the sealed peripheral edge portions, said sealed peripheral edge portions being subjected to an easily peel-off treatment so that the sealed peripheral edge portions are separated and peeled off from each other when the package is opened;

a seal opening starting portion formed outside of one of the sealed peripheral edge portions so that the film materials are separated from each other at the seal opening starting portion; and at least one projection provided on an inner surface of the film materials forming the seal opening starting portion;

wherein said at least one projection defines a thickness at said seal opening starting portion that is substantially equal to a thickness of the content accommodation compartment containing the content, wherein said sealed peripheral edge has a thickness that is less than said thickness of the content accommodation compartment;

wherein said projection is composed of a curved projection member extending transversely at a portion at which the seal opening starting portion is formed.

13. A package comprising:

a package body formed by mating foldable laminate film materials and sealing peripheral edge portions of the mated film materials so as to form a content accommodation compartment inside the sealed peripheral edge portions, said sealed peripheral edge portions being subjected to an easily peel-off treatment so that the sealed peripheral edge portions are separated and peeled off from each other when the package is opened;

a seal opening starting portion formed outside of one of the sealed peripheral edge portions so that the film materials are separated from each other at the seal opening starting portion; and at least one projection provided on an inner surface of the film materials forming the seal opening starting portion;

wherein said at least one projection defines a thickness at said seal opening starting portion that is substantially equal to a thickness of the content accommodation compartment containing the content, wherein said sealed peripheral edge has a thickness that is less than said thickness of the content accommodation compartment;

wherein said sealed peripheral edge portions of the mated film material have a peel-off strength that is less than a peel-off strength at said seal opening starting portion.

14. The package according to claim 13, wherein a peel-off strength of said sealed peripheral edge at said seal opening starting position comprises approximately 2000 g/15 mm.

15. The package according to claim 13, wherein a peel-off strength of said sealed peripheral edge at said seal opening starting position comprises between approximately 500 and 2000 g/15 mm.

16. A contact lens package, comprising:

a package body formed by mating foldable laminate film materials and sealing peripheral edge portions of the mated film materials so as to form a content accommodation compartment inside the sealed peripheral edge portions, said sealed peripheral edge portions being subjected to an easily peel-off treatment so that the sealed peripheral edge portions are separated and peeled off from each other when the package is opened;

a seal opening starting portion formed outside of one of the sealed peripheral edge portions so that the film materials are separated from each other at the seal opening starting portion; and at least one projection provided on an inner surface of each of the film materials forming the seal opening starting portion, wherein said projections provided on the surfaces of both the film materials are shifted in positions from each other;

wherein said projection is provided on the surface of the film material by one of a fusing process by means of hot air, a heat-seal treatment, or bonding;

wherein said at least one projection extends substantially across a portion of said contact lens package at the seal opening starting portion and defines a thickness at said seal opening starting portion that is substantially equal to a thickness of the content accommodation compartment containing the content, wherein said sealed peripheral edge has a thickness that is less than said thickness of the content accommodation compartment.

17. The package according to claim 16, wherein one sheet of film material is folded at a central portion in a longitudinal direction thereof and the folded film materials are mated and sealed to each other at peripheral edge portions other than the folded one edge portion, and the seal opening starting portion is formed on the edge side portion opposing to the folded one edge side portion.

18. A contact lens package, comprising:

a package body formed by mating foldable laminate film materials and sealing peripheral edge portions of the mated film materials so as to form a content accommodation compartment inside the sealed peripheral edge portions, said sealed peripheral edge portions being subjected to an easily peel-off treatment so that the sealed peripheral edge portions are separated and peeled off from each other when the package is opened;

a seal opening starting portion formed outside of one of the sealed peripheral edge portions so that the film materials are separated from each other at the seal opening starting portion; and at least one projection provided on an inner surface of each of the film materials forming the seal opening starting portion, wherein said projections provided on the surfaces of both the film materials are shifted in positions from each other;

wherein said projection is provided on the surface of the film material by one of a fusing process by means of hot air, a heat-seal treatment, or bonding;

wherein said at least one projection extends substantially across a portion of said contact lens package at the seal opening starting portion and defines a thickness at said seal opening starting portion that is substantially equal to a thickness of the content accommodation compartment containing the content, wherein said sealed peripheral edge has a thickness that is less than said thickness of the content accommodation compartment;

wherein one sheet of film material is folded at a central portion in a longitudinal direction thereof and the folded film materials are mated and sealed to each other at peripheral edge portions other than the folded one edge portion, and the seal opening starting portion is formed on the edge side portion opposing to the folded one edge side portion;

wherein said sealed peripheral edge portions of the mated film material have a peel-off strength that is less than a peel-off strength at said seal opening starting portion, wherein a peel-off strength of said sealed peripheral edge at said seal opening starting position comprises approximately 2000 g/15 mm.

* * * * *